US005555732A

United States Patent [19]

Whiticar

[11] Patent Number: 5,555,732

[45] Date of Patent: Sep. 17, 1996

[54] PORTABLE DEHUMIDIFIER

[76] Inventor: John Whiticar, 4705 NE. Palmetto Dr., Jensen Beach, Fla. 34957

[21] Appl. No.: 385,835

[22] Filed: Feb. 9, 1995

[51] Int. Cl.[6] ..... F24F 1/00

[52] U.S. Cl. ..... 62/3.4; 62/93

[58] Field of Search ..... 62/3.2, 3.3, 3.4, 62/3.62, 93, 150, 285, 291

[56] References Cited

U.S. PATENT DOCUMENTS

| | | | |
|---|---|---|---|
| 2,944,404 | 7/1960 | Fritts | 62/3.4 |
| 3,024,616 | 3/1962 | Bury | 62/3.4 |
| 3,050,948 | 8/1962 | Jones | 62/3.4 |
| 3,126,710 | 3/1964 | Boehmer et al. | 62/3.4 |
| 3,870,633 | 3/1975 | Setterstrom | 210/136 |
| 4,400,948 | 8/1983 | Moorehead | 62/3 |
| 4,428,207 | 1/1984 | Hall | 62/176.1 |
| 5,003,162 | 3/1991 | Townsend et al. | 219/506 |
| 5,212,958 | 5/1993 | Anderson | 62/150 |
| 5,375,421 | 12/1994 | Hsieh | 62/3.4 |

*Primary Examiner*—Henry A. Bennett
*Assistant Examiner*—William C. Doerrler
*Attorney, Agent, or Firm*—Tom Hamill, Jr.

[57] ABSTRACT

A portable dehumidifier is provided which includes an upper section housing a power supply, a small thermoelectric device intermediate a cold plate and a heat sink, and a blower fan. The blower fan provides the motive force to cause the humid air to come in contact with the cold plate. The cold plate causes the water vapor to condense from the air. The condensate drips from the cold plate into a trap where it is funnelled into a lower section. The upper section is mounted atop a lower section. The lower section includes a reservoir for collection the condensed water and is provided with a drain valve, float switch and vapor barrier. The drain valve permits the reservoir to be emptied of condensate. The float switch disengages the portable dehumidifier when the reservoir becomes full of condensate. The vapor barrier prevents the condensate in the reservoir from re-evaporating back into the system. The portable dehumidifier will incorporate several safety and status features, including a tip over safety switch, which disengages the unit if tipped over and an audible alarm which engages when the reservoir is full. The size of the unit, power requirements and extreme portability permits the portable dehumidifier to be utilized in campers, mobile homes, small enclosed spaces and marine applications.

14 Claims, 3 Drawing Sheets

PORTABLE DEHUMIDIFIER

BACKGROUND OF THE INVENTION

1. Field of the Invention

The present invention relates generally to humidifiers, and more particularly to portable humidifiers utilizing a thermoelectric element with safety and status features.

2. Description of the Prior Art

Humidifiers employing a thermoelectric element are well known in the art of devices for drying air. U.S. Pat. No. 4,428,207 discloses a dehumidifier with an evaporator, condenser and fan positioned in a vertical orientation from top to bottom in the dehumidifier housing. This device incorporates the provision of a conventional refrigerant evaporator and condenser.

U.S. Pat. No. 3,050,948 discloses a thermoelectric dehumidifier. A thermoelectric module is disposed within a housing. Moist air is caused to flow over the thermoelectric module by a blower fan. The blower fan is disposed in horizontal relation to the thermoelectric module. A condensate reservoir is provided below the thermoelectric module.

Thus, while the foregoing body of prior art indicates it to be well known to use thermoelectric modules, blower fans and condensate reservoirs in dehumidification units, the provision of a highly portable and cost effective device is not contemplated. Nor does the prior art described above teach or suggest a device which incorporates safety and status features. The foregoing disadvantages are overcome by the unique structural configuration of the present invention as will be made apparent from the following description thereof. Other advantages of the present invention over the prior art also will be rendered evident.

SUMMARY OF THE INVENTION

Most humidifiers are heavy and bulky. They are designed to be used in large room and other large areas. These large humidifiers utilize a great deal of electricity, are noisy and relatively expensive. The portable dehumidifier of the instant invention is light weight, extremely portable and may be used in small enclosures. It utilizes very little electricity and has fewer components than other humidifiers. Therefore, to achieve the foregoing and other advantages, the present invention, briefly described, provides a small, lightweight, portable dehumidifier which includes an upper section housing a power supply, a small thermoelectric device intermediate a cold plate and a heat sink, and a blower fan. The blower fan causes humid air to come in contact with the cold plate. The cold plate causes the water vapor to condense from the air. The condensate drips from the cold plate into a trap where it is funnelled into a lower section. The upper section is mounted atop a lower section. The lower section includes a reservoir for collection the condensed water and is provided with a drain valve, float switch and vapor barrier. The drain valve permits the reservoir to be emptied of condensate. The float switch disengages the portable dehumidifier when the reservoir becomes full of condensate. The vapor barrier prevents the condensate in the reservoir from re-evaporating back into the system. The portable dehumidifier will incorporate several safety and status features, including a tip over safety switch, which disengages the unit if tipped over and an audible alarm which engages when the reservoir is full. The size of the unit, power requirements and extreme portability permits the portable dehumidifier to be utilized in campers, mobile homes, small enclosed spaces and marine applications. It is envisioned that the novel structure of the portable dehumidifier be constructed of off the shelf and commercially available components.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms of phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a portable dehumidifier with the internal components configured within the housing in such a fashion which permits the portable dehumidifier to be small, lightweight and extremely portable.

Still yet a further object of the present invention is to provide a portable dehumidifier with improved safety and status features.

It is another object of the present invention to provide a portable dehumidifier which may be easily and efficiently manufactured and marketed, and is of durable and reliable construct ion, and utilizes off the shelf components.

An even further object of the present invention is to provide a portable dehumidifier which is susceptible of a low cost of manufacture with regard to both materials and labor, and which accordingly is then susceptible of low prices of sale to the consuming public, thereby making such a portable dehumidifier available to the buying public.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENT

With reference now to the drawings, a new and improved portable dehumidifier embodying the principles and concepts of the present invention will be described.

Figure 1:
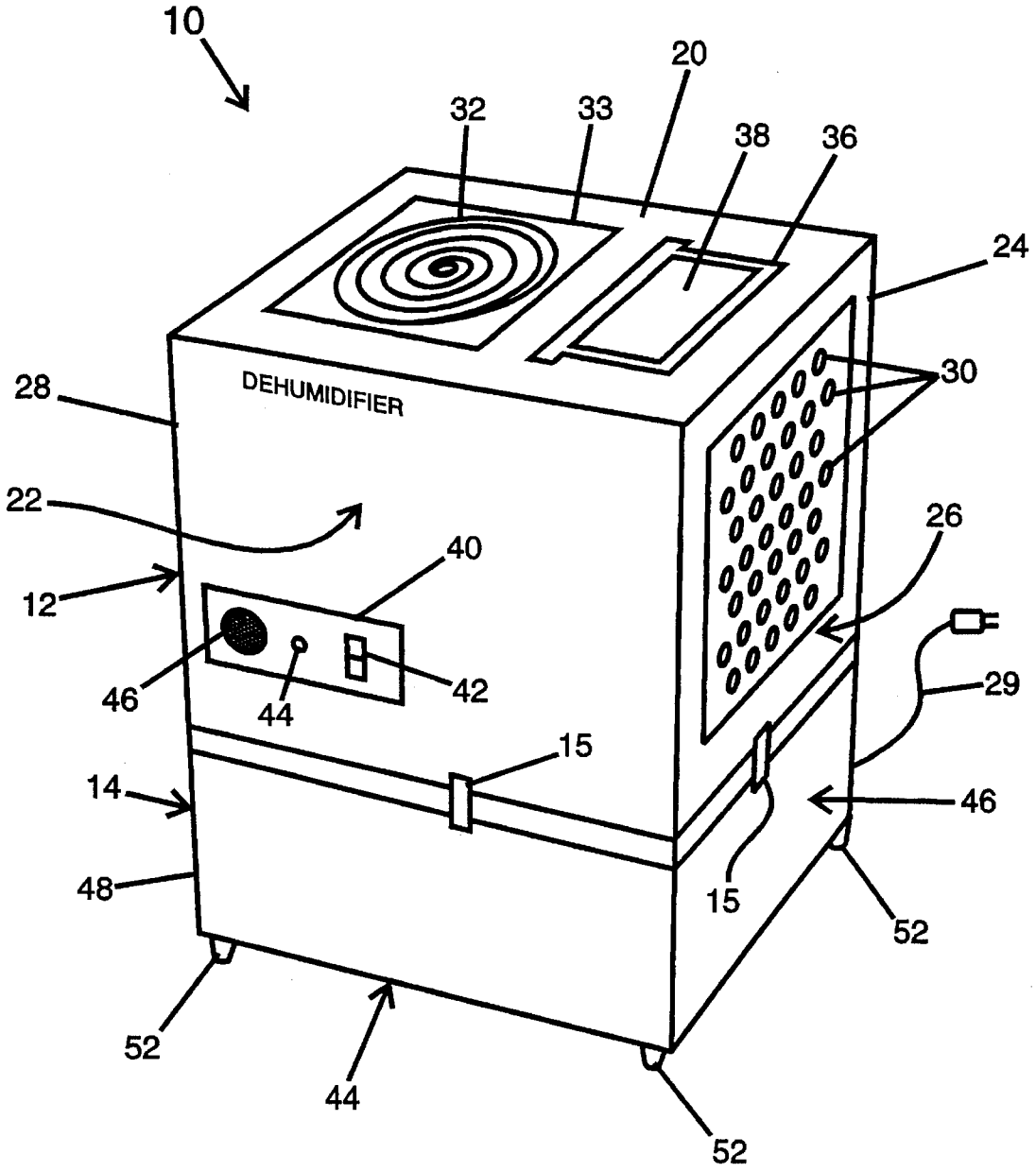
FIG. 1 is a perspective view showing the preferred embodiment of the portable dehumidifier of the invention.

Turning initially to FIG. 1 there is shown an exemplary embodiment of the portable dehumidifier of the invention generally designated by reference numeral 10. In its preferred form, the portable humidifier 10 comprises generally a rectangular housing with an upper housing section 12 and a lower housing section 14. The upper housing section 12 is attached to the lower housing section 14 by suitable attachment means 15. Attachment means 15 may be in the form of clasps, fasteners, clamps, or any other suitable attachment devices. It is also envisioned that the lower housing section 14 may be fixed and include a tray element which would be moveable in a lateral fashion. This pull out tray may house a fluid reservoir.

Upper housing section 12 includes a top panel 20, a front panel 22, a rear panel 24, a right panel 26 and a left panel 28. The upper housing section 12 forms an enclosure which various interior devices are arranged. The arrangement and specifics of the devices included therein will be discussed in FIG. 2. The right panel 26 has a plurality of air entry openings 30 provided thereon. The air entry openings 30 may be holes, slots or other air egress means. The air entry openings 30 permit moist air to be brought to the interior of the upper housing section 12. A filter may wished to be employed in front of the air entry openings 30 in certain environments.

The top panel 20 includes an air exit opening 33 which are located directly above a blower fan unit 32. The blower fan unit 32 provides a motive force to both draw the moist air in through air entry openings 30 and expel the dry air through air exit opening 33. The top panel 20 is also provided with recess 38 designed to receive a handle 36. The handle 36 may be pulled out of the recess 38 into a vertical orientation, which would permit the portable dehumidifier 10 to be easily carried.

The front panel 22 is provided with a control panel 40. The control panel includes an on-off switch 42, a light 44, and an audible means 46. The audio means may be a speaker, alarm or piezoelectric tweeter. The on-off switch 42 permits the user to turn the portable dehumidifier on and off. The light 44 will be on when the portable dehumidifier 10 is on, and will be off when the portable dehumidifier is off. This permits the user to determine with ease the on-off status of the portable dehumidifier. Audible means 46 emits an audible signal when the condensate reservoir is full and requires emptying. An audible signal such as a continuous tone, regularly chirping or beeping have been considered. Other status and safety features may be displayed on the control panel 40, and yet still other status and safety features will become apparent in the discussion of FIG. 3.

Left panel 28 has a power cord 29 depending therefrom. The power cord is to be plugged into to any standard outlet. The specifications of the internal electronics may be altered to permit the portable dehumidifier to function on 220 VAC as opposed to the standard US 110 VAC.

Lower housing section 14 includes a front side panel 43, a bottom side panel 45, a right side panel 47, a left side panel 48, and a rear side panel 50. The lower housing section 14 forms an enclosure which various interior devices are arranged. The arrangement and specifics of the devices included therein are discussed in the discussion of FIG. 2.

Bottom panel 45 has leg elements 52 depending downward therefrom, permitting the portable dehumidifier to be raised above the surface upon which it rests.

The portable dehumidifier 10 is designed to be small, compact, lightweight and durable. The size may vary; however, it is proposed that the portable dehumidifier will occupy 576 cubic inches, being roughly 12 inches high, 6 inches deep and 8 inches wide. The portable dehumidifier 10 will weigh approx. 10 lbs.

Figure 2:
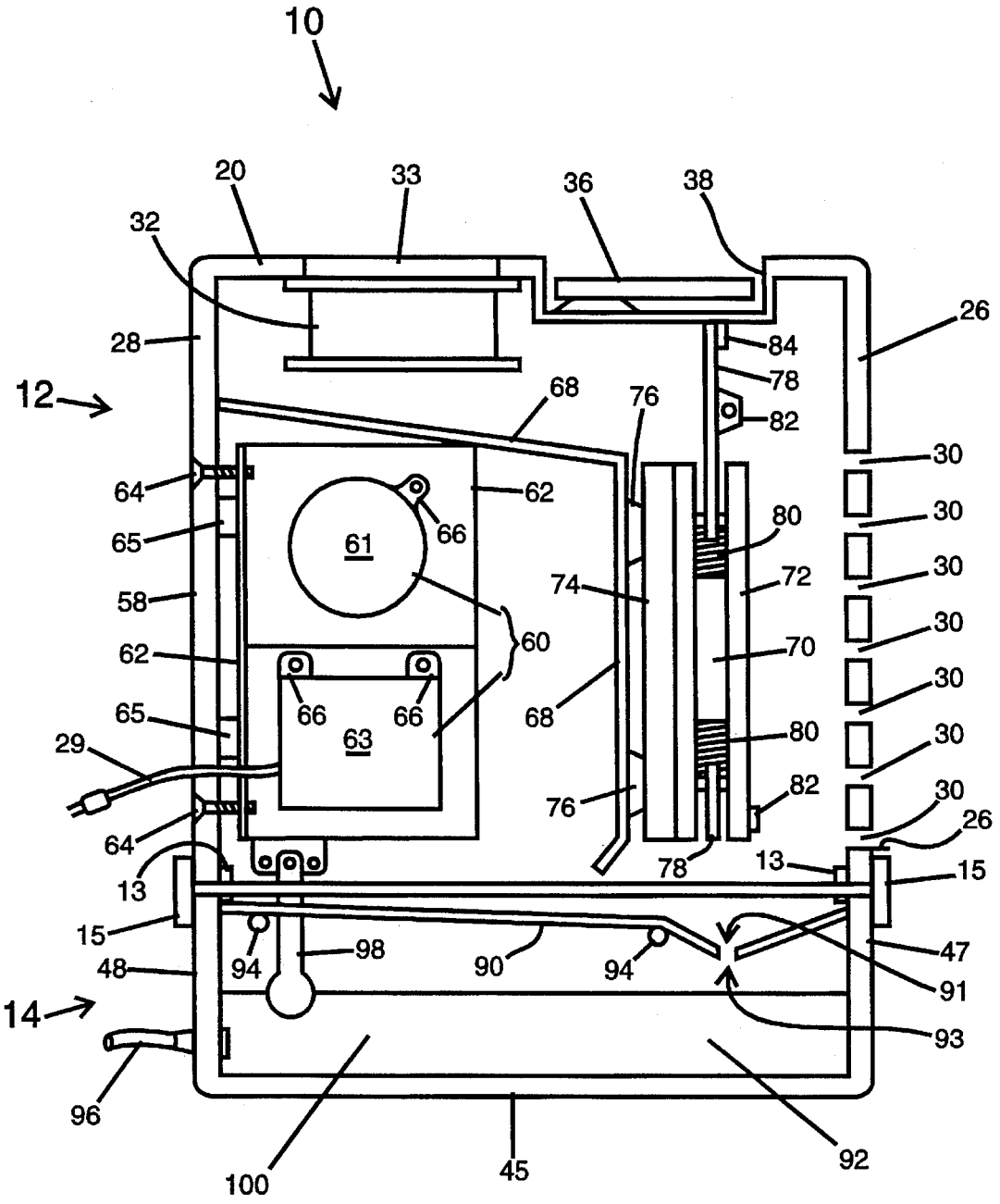
FIG. 2 is a cross-sectional elevational view of the portable dehumidifier along line 2—2 of FIG. 1.

Referring now to FIG. 2, the portable dehumidifier 10 is shown in a cut-away view. The upper housing section 12 is shown resting on top of the lower housing section 14. Attachment means 15 secures the upper housing section 12 to the lower housing section 14. Guide means 13 are secured to the upper housing section 12 panels. This permits the easy and rapid assembly of the upper housing section 12 to the lower housing section 14. A power supply 60 is provided in the upper housing section 12. The power supply 60 includes a transformer 63 and a capacitor 61. The power supply also may include other electronic components as part of its assembly. The capacitor 61 and the transformer 63 are mounted by an appropriate means to a power supply support plate 62 which is a plate which is bent at a right angle. The power supply support plate 62 is secured to the left panel 28 by fastening means 64. Washer elements 65 are provided intermediate the power support plate 62 and the left panel 28. The washer elements 65 keep the power support plate 62 secured at the preferred distance from the left panel 28. The power supply 60 is secured to the power supply support plate 62 by the power supply fasteners 66. Power cord 29 is attached to the power supply 60 which includes a transformer and a capacitor which converts the voltage from 110 VAC to 12 VDC. A power supply isolation plate 68 surrounds the power supply 60 to isolate it from the moist air which is drawn into the portable dehumidifier 10.

A thermoelectric device 70 is provided. The thermoelectric device 70 is intermediate the cold plate 72 and the finned hot plate 74. The finned hot plate 74 is secured to the power supply isolation plate 68 by securing elements 76. The securing elements 76 are attached by a fastening means to both the power supply isolation plate 68 and the finned hot plate 74. The cold plate 72 and the finned hot plate 74 are separated by a separation plate 78. The separation plate 78 is secured intermediate the finned hot plate 74 and the cold plate 72 by an adhesive filler 80, as well as other attachment means. The adhesive filler 80 also acts as an insulator between the cold plate 72 and the finned hot plate 74. The separation plate 78 acts as a structural support for the thermoelectric assembly, including the thermoelectric device 70, the cold plate 72 and the finned hot plate 74. The separation plate 78 is attached to both the front panel 22 and the rear panel 24 by attachment means 82. Attachment means 82 is secured to both the separation plate 78 and the front panel 22, as well as the rear panel 24. The separation plate may also be further secured to the top panel 20 by a securing element 84. Right side panel 26 is provided with a plurality of air entry openings 30.

The top panel 20 has a blower fan 32 secured thereto by appropriate fasteners. The blower fan 32 is oriented in such a manner to pull moist air in through the air entry openings 30. A recess 38 is also provided on the top panel 20 with a handle 36 received therein. The handle 36 is oriented in such a fashion as to permit its employ when desired, and to permit the handle 36 to lay in the recess 38 when not in use.

The lower housing section 14 has a vapor barrier 90 suspended above a condensate reservoir 92. Support elements 94 are provided on the front side panel 43 and the rear side panel 50. The vapor barrier 90 rests on the support elements 94 whereby the vapor barrier 90 may be removed easily. The vapor barrier 90 insures that the condensate does not re-evaporate back into the system. A condensate exit tube 96 is provided in the left side panel 48. The condensate exit tube 96 may be replaced by a plug for certain applications of the portable dehumidifier. A float assembly 98 is provided. The float assembly 98 rises as the condensate 100 level rises in the condensate reservoir 92. The float assembly 98 is operatively connected to the power supply 60 located in the upper housing section 12. When the float assembly 98 rises above a predetermined value, the power supply 60 is switched off, powering down the thermoelectric device 70 and the blower fan 32. The switch activated by the float assembly 98 may be a mercury switch, a micro-switch or a mechanical switch.

The blower fan 32 causes moist air to enter through the air entry openings 30. This moist air comes into contact with the cold plate 72. The temperature of the cold plate 72 is such that a liquid condensate forms on the cold plate 72. The cold plate 72 is oriented vertically above the vapor barrier 90. Vapor barrier 90 is sloped toward the right side panel 47. Proximal the right side panel 47, the vapor barrier includes a V-shaped depression 91 with exit holes 93 located at its apex. Condensate drips from the cold plate 72 and falls onto the vapor barrier 92, where gravity pulls the condensate into the V-shaped depression, where it falls into the condensate reservoir 92. The now "dry" air is pulled through the finned hot plate 74 by the action of the blower fan 32. The power supply isolation plate 68 and the separation plate 78 generates a flow path for the "dry" air. The "dry" air is heated, that is the air extracts the heat from the hot side of the thermoelectric device, making the cold plate cold, by the finned hot plate 74, and then expelled by the blower fan 32 through the air exit opening 33 located on the top panel 20. An air channel is formed between the air entry openings 30, air exit openings 33, power supply isolation plate 68, and the separation plate 78.

The upper housing section 12 is detachable from the lower housing section 14. This facilitates the cleaning of the vapor barrier 90 and the reservoir 92 from biofouling.

Figure 3:
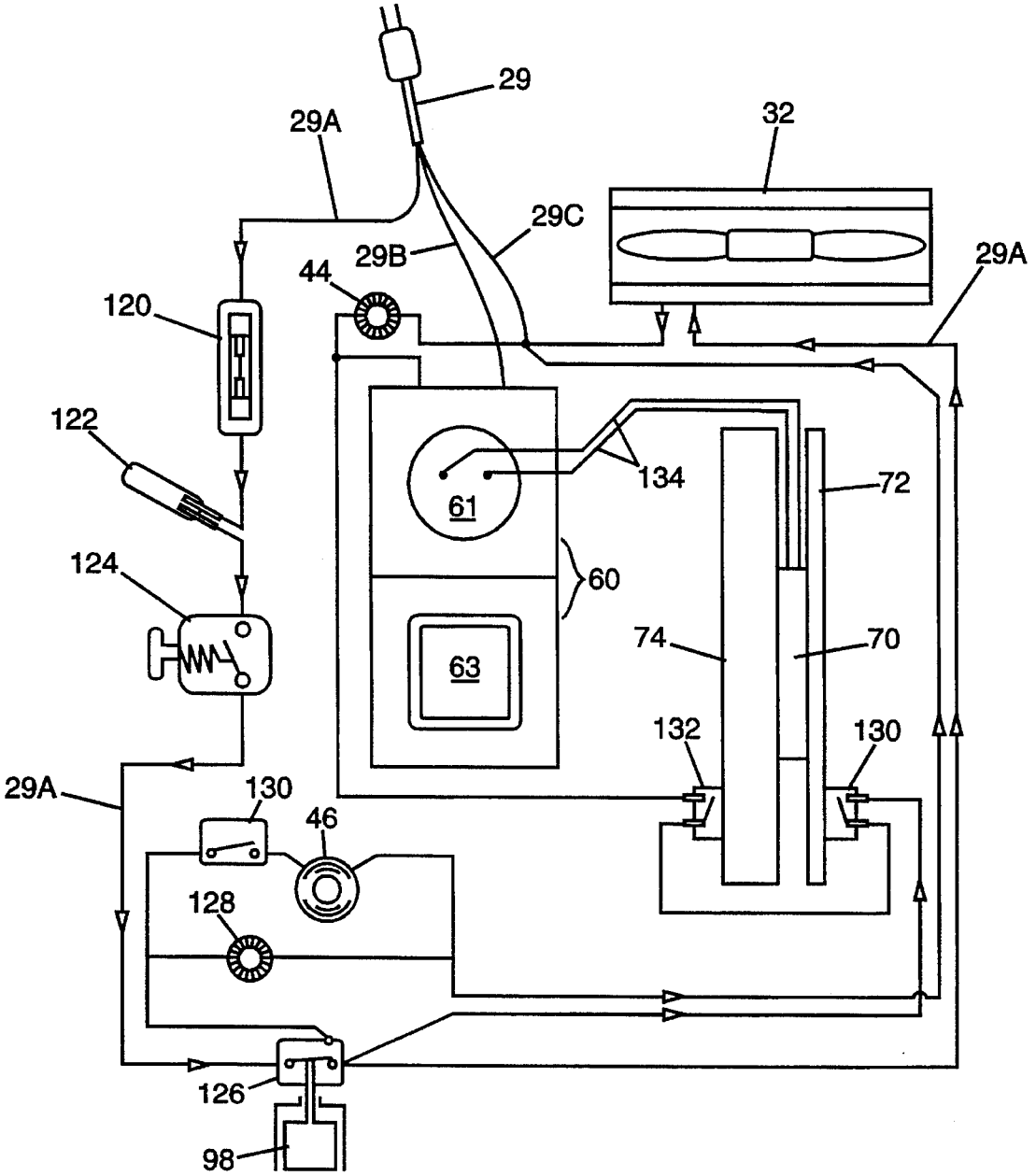
FIG. 3 is a schematic of the electrical circuit which incorporates the various safety and status features of the portable dehumidifier.

Referring now to FIG. 3, a circuit schematic is provided for the portable dehumidifier 10. Plug 29 provides a 120 Volt alternating current source. Wire 29C is the neutral wire. Wire 29B is the ground wire and is appropriately grounded. Wire 29A is the hot wire. Hot wire 29A is connected to a fuse 120. In case of a power surge the fuse 120 will protect the other elements of the circuit. A mercury safety switch 122 is provided after the fuse 120. The mercury safety switch 122 insures that the portable dehumidifier 10 will be shut off in case it is inadvertently turned over. A humidistat 124 is provided in the circuit path as well. The humidistat 124 will activate or deactivate the portable dehumidifier 10 as a result of the ambient air humidity. Some applications will require that the portable dehumidifier 10 run 24 hours a day. In these applications a humidistat would not be required.

A float switch 126 is employed as part of the float assembly 98. The float switch 126 is a double throw switch. When the condensate 100 rises above a certain predetermined level in the condensate reservoir 92, the float switch 126 will disengage. Reservoir full light 128 will actuate when the condensate reservoir 92 is full. An audible alert on-off switch 130 is also provided. The audible alert on-off switch 130 may be implemented by the user if it is desired to hear an audible signal when the condensate reservoir 92 is full. The audible signal will be generated through speaker 46.

A frost switch 130 is provided in conjunction with the cold plate 72. The frost switch 130 may be, but is not limited to, a snap action button switch. The function of this frost switch 130 would be to shut the unit off if the cold plate 72 were to freeze over with condensate. Although generally not a concern in warmer climates, this frost switch 130 would prevent the unit from "freezing" up in colder climes.

A over heat switch 132 would be provided in conjunction with the finned hot plate 74. The over heat switch 132, may be, but is not limited to, a snap action button switch. The over heat switch 132 would shut down the power supply 60 in the event that the finned hot plate 74 overheats. This may occur if the blower fan 32 fails or if a blanket or other object interfered with the free air passage through the portable dehumidifier 10.

Blower fan 32 also runs off of line 29A. Light 44 indicated that the portable dehumidifier 10 is on.

Power supply 60 steps down the 110 VAC to 12 VDC through the transformer 63 and subsequent capacitor 61. Diodes are found between the transformer 63 and capacitor 61 and are sometimes called triacs. 12 VDC is sent through wire 134 to run the thermoelectric module 70. It is to be understood that the voltage may not be exactly 12 VDC but may be in the range of 11 VDC to 16 VDC.

It has also been considered to employ a small logic unit which may monitor the temperature of the air, the finned hot plate 74, the cold plate 72, power supply temperature and desired humidity. The logic unit could implement the over heat switch 132, the frost switch 130, and the on-off of the portable humidifier 10 in response to the float switch 126. One may also program the logic unit to operate the portable dehumidifier 10 under certain parameters such as time, date, and variations in humidity.

It is apparent from the above that the present invention accomplishes all of the objectives set forth by providing a portable dehumidifier with the internal components configured within the housing in such a fashion which permits the portable dehumidifier to be small, lightweight and extremely portable, which includes improved safety and status features, and is of durable and reliable construction, utilizing off the shelf components.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

I claim:

1. A portable dehumidifier comprising:

a housing having an air inlet and an air outlet and an upper chamber and a lower chamber, said upper chamber including a thermoelectric module and a power supply, said thermoelectric module separated from said power supply by a first wall, said thermoelectric module further including a cold plate and a finned hot plate, said cold plate separated from said finned hot plate by a second wall, an air passage, said air passage formed between said air inlet said air outlet, said first wall and said second wall, a blower fan, said blower fan located in said upper chamber proximal said air outlet, said lower chamber including a condensate reservoir, said condensate reservoir separated from said upper chamber by a vapor barrier, said vapor barrier including a channel, said channel located directly underneath said cold plate, said condensate reservoir further including a condensate exit means, whereby air enters said upper chamber through said air inlet and comes in contact with said cold plate causing vapor entrained in the air to condense on said cold plate forming a condensate, said condensate falling onto said vapor barrier and passing through said channel into said condensate reservoir, said dehumidified air further passes over and cooling said finned hot plate and then exiting said upper chamber through said air outlet.

2. The invention of claim 1 including a first safety means, said first safety means including a mercury switch in series with said power supply, whereby said mercury switch will disengage said power supply if said portable humidifier is not maintained in a vertical orientation.

3. The invention of claim 2 including a second safety means, said second safety means including a float switch in series with said power supply, said float switch further mechanically connected to a float means, said float means residing in said condensate reservoir, said float further displaceable with the level of condensate in said condensate reservoir, whereby when said float displaces above a predetermined value, said float switch will disengage said power supply.

4. The invention of claim 3 wherein a first light is engaged when said float switch disengages said power supply.

5. The invention of claim 4 wherein an audible signal is generated when said float switch disengages said power supply.

6. The invention of claim 5 including means to deactivate said audible signal.

7. The invention of claim 6 including securing means to detachably secure said upper chamber to said lower chamber.

8. The invention of claim 7 wherein said securing means includes mechanical fasteners.

9. The invention of claim 8 wherein said condensate reservoir includes a condensate exit means, said condensate exit means including an aperture and a first element, said first element designed to receive a tube means, whereby said condensate may be drained out of said condensate reservoir by said tube means.

10. The invention of claim 1 wherein said upper chamber has a top panel, said air exit located on said top panel, said top panel further including a handle.

11. The invention of claim 10 wherein said top panel includes a recess, said recess having said handle residing therein.

12. The invention of claim 3 wherein said float switch is a switch selected from the group of mercury switches and mechanical switches.

13. The invention of claim 1 wherein said finned hot plate includes temperature detection means, and further includes a temperature control switch means to disengage said power supply if said finned hot plate overheats.

14. The invention of claim 1 wherein the air passing through said air channel cools said finned hot plate and said power supply.

* * * * *